US008550183B2

(12) United States Patent
Forster et al.

(10) Patent No.: US 8,550,183 B2
(45) Date of Patent: Oct. 8, 2013

(54) DRILLING METHOD

(75) Inventors: Ian Forster, Aberdeen (GB); Alan Eddison, Aberdeen (GB); Alastair MacFarlane, Aberdeen (GB)

(73) Assignee: National Oilwell Varco, L.P., Houston, TX (US)

( * ) Notice: Subject to any disclaimer, the term of this patent is extended or adjusted under 35 U.S.C. 154(b) by 519 days.

(21) Appl. No.: 12/568,720

(22) Filed: Sep. 29, 2009

(65) Prior Publication Data

US 2010/0089647 A1 Apr. 15, 2010

(30) Foreign Application Priority Data

Oct. 9, 2008 (GB) ..... 0818499.6
Sep. 14, 2009 (GB) ..... 0916033.4

(51) Int. Cl.
*E21B 7/00* (2006.01)
*E21B 7/24* (2006.01)

(52) U.S. Cl.
USPC ..... 175/57; 175/55; 175/56

(58) Field of Classification Search
USPC ..... 175/57, 55, 56, 325.1, 325.2
See application file for complete search history.

(56) References Cited

U.S. PATENT DOCUMENTS

| | | | | |
|---|---|---|---|---|
| 2,712,434 A | | 7/1955 | Giles et al. | 255/1.6 |
| 3,049,185 A | * | 8/1962 | Herbold | 175/19 |
| 3,068,946 A | | 12/1962 | Frisby et al. | 175/73 |
| 3,237,705 A | | 3/1966 | Williams | 175/406 |
| 3,561,549 A | | 2/1971 | Garrison et al. | 175/76 |
| 3,753,470 A | | 8/1973 | Lagerstrom et al. | 175/292 |
| 3,880,246 A | | 4/1975 | Farris | 175/61 |
| 4,080,010 A | | 3/1978 | Young | 308/4 A |
| 4,185,704 A | | 1/1980 | Nixon, Jr. | 175/76 |
| 4,220,213 A | | 9/1980 | Hamilton | 175/45 |
| 4,465,147 A | | 8/1984 | Feenstra et al. | 175/73 |
| 4,729,438 A | | 3/1988 | Walker et al. | 175/76 |
| 4,807,708 A | | 2/1989 | Forrest et al. | 175/45 |
| 4,982,802 A | | 1/1991 | Warren et al. | 175/57 |
| 5,050,692 A | | 9/1991 | Beimgraben | 175/61 |
| 5,094,304 A | | 3/1992 | Briggs | 175/61 |
| 5,117,926 A | | 6/1992 | Worrall et al. | 175/56 |
| 5,313,829 A | | 5/1994 | Paslay et al. | 73/151 |
| 5,402,677 A | | 4/1995 | Paslay et al. | 73/151 |
| 5,423,389 A | | 6/1995 | Warren et al. | 175/75 |
| 5,495,899 A | | 3/1996 | Pastusek et al. | 175/57 |
| 5,979,570 A | * | 11/1999 | McLoughlin et al. | 175/24 |
| 6,116,356 A | * | 9/2000 | Doster et al. | 175/75 |
| 6,205,851 B1 | | 3/2001 | Jogi | 73/152.47 |
| 6,325,162 B1 | * | 12/2001 | Eppink et al. | 175/57 |

(Continued)

FOREIGN PATENT DOCUMENTS

| | | |
|---|---|---|
| EP | 0 550 254 B1 | 10/1996 |
| GB | 2 294 071 | 4/1996 |

(Continued)

OTHER PUBLICATIONS

GB Application No. 0917213.1 Search Report (Jan. 26, 2010).

(Continued)

*Primary Examiner* — Giovanna Wright
(74) *Attorney, Agent, or Firm* — JL Salazar Law Firm

(57) ABSTRACT

A drilling method comprises controlling operation of a drill string to maintain at least a portion of the drill string in forward whirl.

54 Claims, 9 Drawing Sheets

(56) References Cited

U.S. PATENT DOCUMENTS

| | | | | |
|---|---|---|---|---|
| 6,739,416 | B2 * | 5/2004 | Presley et al. | 175/385 |
| 7,185,715 | B2 * | 3/2007 | Krueger et al. | 175/40 |
| 2001/0047884 | A1 * | 12/2001 | Eddison | 175/61 |
| 2002/0185315 | A1 | 12/2002 | McLoughlin et al. | 175/76 |
| 2007/0289778 | A1 * | 12/2007 | Watkins et al. | 175/40 |

FOREIGN PATENT DOCUMENTS

| | | |
|---|---|---|
| GB | 2 337 066 | 11/1999 |
| WO | WO99/23346 | 5/1999 |
| WO | WO01/63087 | 8/2001 |
| WO | WO2004/109052 | 12/2004 |
| WO | WO2009/051950 | 4/2009 |

OTHER PUBLICATIONS

Halsey et al., "Torque Feedback Used to Cure Slip-Stick Motion," *SPE 18049* (1988).

Jansen et al., *Journal of Sound and Vibration* 179(4):647-668 (1995).

Pavone, "Application of High Sampling Rate Downhole Measurements for Analysis and Cure of Stick-Slip in Drilling," *SPE 28324* (1994).

Office Action dated Aug. 24, 2012 for counterpart Mexican Application No. MX/a/20091010905.

Nov. 27, 2012, Response in counterpart application MX/a/2009/010905, 17 pages.

Dec. 27, 2012, Examination Report Under Section 18(3) in counterpart application GB0917213.1, 2 pages.

ReedHycalog. Improved Bi-Center bits Tackle Smaller Hole Sizes [online], [retrieved on Jan. 10, 2013]. Retrieved from the Internet URL http://208.88.130.69/article.aspx?id=33758.

World Oil. Bit Technology keeps Pave with Operator Activity [online], [retrieved on Jan. 10, 2013]. Retrieved from the Internet URL http://www.worldoil.com/Nov-2006-Bit-technology-keeps-pace-with-operator-activity.html.

* cited by examiner

DRILLING METHOD

CROSS-REFERENCE TO RELATED APPLICATIONS

This application claims priority from GB Patent applications: GB 0818499.6 filed on Oct. 9, 2008; and GB 0916033.4 filed on Sep. 14, 2009.

BACKGROUND OF THE INVENTION

1. Field of the Invention

This invention relates to a drilling method, such as is used to access subsurface formations. In particular, the invention relates to methods and apparatus to facilitate the avoidance of undesirable vibration or other forms of movement in the drilling apparatus.

2. Description of the Related Art

Bores may be drilled into the earth for a number of reasons, for example to access aquifers or hydrocarbon-bearing formations. Conventionally, drilling is achieved by mounting a drill bit on the leading or distal end of an elongate support, which may take the form of a drill string. The drill bit may be driven by rotating the drill string by a surface motor, or by using a downhole motor. Drill bits take many different forms, and may be operated in conjunction with reamers or other cutting tools utilized to increase the diameter of a pre-drilled bore.

Drilling operators face increasing challenges in achieving efficient drilling of bores to access hydrocarbon-bearing formations. More readily accessible reservoirs are being exhausted, and accessing new reservoirs typically involves drilling deeper and though harder rock formations. In addition, a single drilling rig site is now often used to access formations a significant distance from the rig, such that inclined and even horizontal bores are being drilled. These changes in drilling practice require provision of longer drill strings and larger capacity surface motors.

One difficulty that operators often encounter, in drilling both shallow and longer reach bores, is that the rotating drill string may experience significant transverse and longitudinal vibration. This will result in parts of the drill string above the drill bit coming into contact with the bore wall. The resulting friction results in a drop in the torque being transmitted to the drill bit from surface, slows the rotation of the string, and may cause wear and damage to the parts of the string coming into contact with the bore wall. The contact between the string and the bore wall may also damage the bore wall. Furthermore, the presence of vibration may induce fatigue failures or other damage to parts of the string and to tools or devices incorporated in the string. Drilling operators also encounter "stick-slip", when friction between parts of the rotating drill string and the bore wall reaches a level where a lower or distal part of the string stops rotating. The drill string motor may stall, or the upper part of the string may continue to rotate, driven by the motor on the surface, until the sum of the torque being applied by the motor and the spring energy stored in the twisted string is sufficient to overcome the frictional forces and the string begins to rotate again. In this situation, the string will initially accelerate sharply to a high rotational speed, during which period the string may experience damaging vibrations, before slowing to match the motor speed. However, the stick-slip sequence will often develop into a repeating pattern or cycle. Clearly this is inefficient, and accelerates wear and damage to the drill string elements.

Another phenomenon experienced by drill strings is whirl. In a drill string experiencing whirl, in addition to the rotation of the string about its axis, portions of the drill string flex and the axis of the string is displaced from the bore axis and follows a path around the bore axis. The path may be substantially circular and concentric with the bore axis, or may be irregular or chaotic. Whirl can be forward, that is in the same direction as the rotation of the string, backwards, that is in the opposite direction to the rotation of the string, or chaotic. It is believed whirl may be induced by a variety of conditions, primarily by a force or mass acting on a portion of the drill string to initially move the portion of the string off the axis of the bore, and then an adjacent larger diameter portion of the rotating string coming into contact with the bore wall. The string may then whirl forwards with the larger diameter portion in sliding contact with the bore wall, whirl backwards with the contact between the larger diameter portion of the rotating string and the bore wall pulling the string backwards round the bore wall, or each contact between the string and bore wall causing the string to be kicked violently away from the wall to create chaotic whirl.

Understandably, whirl is considered to be undesirable, due to the increased friction that occurs as the larger diameter elements of the drill string come into contact with the bore wall, the resulting wear on the drill string elements, damage to instruments and devices in the drill string, the potential for damage to the bore wall, the resulting shock loads on the drill string, and the stresses and strains induced in the string as the string flexes.

Drilling engineers seek to avoid the creation of excess vibration, whirl and "stick-slip" in drill strings by various methods, including: appropriate selection of drill string elements such as bits, collars and stabilizers; selection of weight applied to the string at surface; selection of torque applied to the string, and selection of string rotational speed. If a drill string begins to vibrate during a drilling operation, a drilling engineer will take various steps to seek to avoid or minimize the vibration, for example reducing the speed of rotation of the string, or the weight applied to the string may be varied. However, it is difficult to predict the combination of string and drilling conditions that will tend to induce vibration, and once such vibration has commenced it can be difficult to stop.

BRIEF SUMMARY OF THE INVENTION

According to a first aspect of the present invention there is provided a drilling method in which a drill string is located in a bore and the string is rotated about an axis, the method comprising offsetting the center of mass of a portion of the drill string from the axis of rotation of the string, wherein rotation of the drill string portion tends to induce deflection of the drill string towards the bore wall in the direction of the offset.

According to a second aspect of the present invention there is provided drilling apparatus comprising a drill string portion configured to offset the center of mass of the portion from an axis of rotation of the string, wherein rotation of a drill string incorporating the portion tends to induce deflection of the drill string towards the bore wall in the direction of the offset.

These aspects of the invention are intended to facilitate creation of a benign forward whirl in the drill string, or at least facilitate suppression of backward or chaotic whirl, or other forms of undesirable vibration. Backward or chaotic whirl are very damaging to BHA components, and are associated with high frequency lateral vibrations and reverse bending stresses. In contrast, forward whirl tends to occur at drill string RPM frequency and creates little if any reverse bending stresses.

The axis of rotation of the string may coincide with the axis of the bore, or may be offset, at least initially, from the bore axis, for example where a drill string is lying towards the low side of an inclined bore.

According to a further aspect of the present invention there is provided a method of controlling vibration in a drill string during a drilling operation, the method comprising at least one of: purposively inducing forward whirl in a distal portion of a drill string, and resisting backward or chaotic whirl.

Surprisingly, intentionally induced forward whirl results in little if any reduction in drilling efficiency compared to a non-whirl condition, and forward whirl may be induced and maintained with an unexpected degree of stability while simultaneously avoiding or minimizing the occurrence of other forms of whirl, stick slip, and undesirable forms of vibration. The occurrence of forward whirl may be encouraged by a number of steps, as will be described.

A drill string experiencing induced forward whirl is robust against external shocks, which in other circumstances will tend to induce large amplitude resonant vibration. Whirl may be induced or maintained with appropriate use of natural or resonant frequencies, and an aspect of the invention involves configuring a portion of the drill string and/or selecting the operating parameter of the string such that the operation of the string is associated with a first order vibration in that portion of the drill string, and avoids the second order vibrations typically associated with drill strings. A first order vibration, which also coincides with inducing forward synchronous whirl, minimizes the occurrence of other, undesirable vibrations, and produces lower stresses on drill string components.

According to another aspect of the present invention there is provided a drilling method comprising:

identifying at least one parameter of the configuration or operation of a drill string which will induce or maintain forward whirl in a distal portion of the drill string; and configuring or operating a drill string to at least one of: induce or maintain forward whirl in a distal portion of the drill string, and resist backward or chaotic whirl.

Thus, an operator may utilize the previously identified parameter or parameters to purposively induce or maintain forward whirl, and preferably forward synchronous whirl. The parameter or parameters may be identified by a variety of means, for example by full scale testing and experimentation, or by laboratory testing designed to permit scaling up. Alternatively, models may be developed and implemented by software. Ranges of physical or operational parameters of the drill string may then be fed into the model, and the model then identifies specific parameters which, if implemented, will lead to creation of the desired forward whirl.

According to a further aspect of the present invention there is provided drilling apparatus comprising a distal end portion of a drill string purposively configured in accordance with predetermined parameters associated with at least one of: creation or maintenance of forward synchronous whirl; and suppressing backward or chaotic whirl.

Operation of the drill string in accordance with predetermined operational parameters will thus induce forward synchronous whirl of the distal end portion, or suppress backward or chaotic whirl.

As noted above, offsetting the center of mass of a portion of the drill string from the axis of rotation of the string is one mechanism which may be used to facilitate the initiation of forward whirl. Rotation of the drill string tends to urge the drill string portion towards the bore wall in the direction of the offset. If the resulting deflection of the drill string is sufficient, a portion of the drill string will come into contact with the bore wall.

Offsetting the center of mass of the drill string portion may be achieved by one or more different mechanisms. Bent subs or other elements for introducing eccentricity may be provided on the string to displace the axis of a portion of the drill string in the bore, and thus offset the center of mass of that portion relative to adjacent portions of the string. As the drill string is rotated, the eccentric string portion will inducing a bowing of the string and eventually lead to whirl. Alternatively or in addition, the drill string portion may be adapted to buckle or otherwise deform to move the portion radially in the bore, and thus move the center of mass of the portion away from the bore axis and the axis of rotation of adjacent portions of the string.

Deformation or offsetting may be achieved by creating a first order vibration in a section of the string, which vibration may be in the region of the natural or critical frequency of the string portion. The vibration may be achieved by rotating the string at a particular speed, and the natural frequency may be associated with a particular rotational speed. The string may be rotated at a speed within a predetermined range of said particular rotational speed, and may be within 70 to 150% of said particular speed. The rotational speed necessary to achieve the desired vibration will be affected by string inclination, due to gravitational effects.

Alternatively, an eccentric mass may be incorporated in the drill string portion. For example, the drill string portion may be tubular and may have a wall portion which is relatively thick, and therefore has a greater mass than an opposite wall portion. High density inserts may be provided on one side of the string portion. An eccentric weighted sleeve may be mounted on a portion of string.

Embodiments may be adapted to allow the offset to be provided selectively, for example a movable sleeve may be provided on the drill string. In one configuration the masses of the sleeve and string combine such that the collective center of mass coincides with the axis of rotation of the string. However, the sleeve is movable relative to the string portion to a second configuration in which the collective center of mass is offset, such that rotation of the string produces an unbalanced radial force on the string portion.

The degree of offset or other feature of drill string configuration may be selected such that the degree of deflection of the drill string necessary to induce whirl only occurs above a predetermined rotational speed. This speed may be within the normal operating parameters of the drill string, or may be above normal operating parameters. Above this predetermined speed whirl is induced and there may be sliding contact between the string portion and the bore wall. The resulting braking effect on drill string rotation by the sliding contact may be utilized to useful effect. For example, in stick-slip, parts of the drill string will tend to experience damaging or disruptive periods of high rotational speed and vibration. The speeds experienced may exceed the upper safe limit for the string. However, in an embodiment of the invention, as the rotational speed of the string approaches the predetermined safe limit, the string portion is adapted to deflect and comes into a sliding, braking contact with the bore wall, and also assumes a stable and relatively benign mode of vibration. The rotation of the string, and the creation of other less desirable modes of vibration, may thus be inhibited and damage to the string and bore by high speed rotation and the associated vibration avoided. Also, this effect may also serve to damp the stick-slip effect and prevent initiation of a stick-slip cycle.

The drill string portion may be located towards the lower or distal portion of the drill string. The drill string will include a bottom hole assembly (BHA), which may include a drill bit, drill collars, and stabilizers. The BHA will be relatively heavy and the drill string portion may be utilized to induce an eccentricity in the rotating BHA associated with a bowing in the drill string or the BHA, which may develop into whirl. The eccentricity may be present in a drill collar forming part of the BHA, or the bowing effect induced by a drill string portion located above the BHA may be sufficient to induce an offset of the center of mass of at least a portion of the rotating BHA, and thus maintain a robust forward whirl condition.

Contact between the rotating drill string and the bore wall creates a reactive force which may tend to initiate undesirable motion, such as backward or chaotic whirl. However, the magnitude of the centripetal force induced by the center of mass offset and the rotation of the string may be sufficient to maintain the desired string configuration and maintain forward whirl. However, other embodiments of the invention suppress the reactive forces created by contact between the rotating string and the bore wall by a number of additional mechanisms or adaptations, as will be described. In one embodiment, the drill string portion is adapted to reduce or minimize friction between the portion and the bore wall. This may be achieved by providing an area of the string portion with a low friction surface, or by including low friction inserts in the surface of the portion. Alternatively, one or more bearing sleeves may be rotatably mounted on the string portion. Thus, if the normal rotation of the bearing sleeve with the string portion is slowed or stopped by contact with the bore wall, the bearing sleeve may rotate freely relative to the string, and the string is maintained in forward whirl.

Alternatively, or in addition, the drill string portion may have an external profile configured to accommodate and maintain the offset and thus maintain forward whirl or at least resist adoption of other forms of movement. For example, the drill string portion may feature a cam lobe or other radial projection configured to trail or follow a surface area of the string portion adapted to be in sliding contact with the bore wall during forward whirl. Friction between the contact area and the bore wall will tend to induce rolling of the drill string around the bore wall in the opposite direction to drill string rotation, and ultimately potentially induce backward whirl. However, such rolling is resisted by the provision of the cam lobe, as backward rolling along the surface of the cam lobe requires the drill string axis to be moved radially inwards, away from the bore wall. Such motion is opposed by the radially outward centripetal force created by the rotation of the offset center of mass of the drill string, and the tendency for backwards rolling is thus suppressed.

The cam lobe or other radial projection may be provided on a stabilizer. However, unlike a conventional stabilizer, which typically functions to centralize the drill string in the bore during a drilling operation, the stabilizer may be configured to accommodate, and indeed assist in maintaining, an offset of the drill string axis from the bore axis.

The drill string portion may include a surface area adapted to accommodate prolonged sliding contact with the bore wall without experiencing undue wear or damage. The area may be provided with a wear-resistant facing, or a wear-resistant insert. The bowing of the drill string induced by embodiments of the invention may also result in other parts of the drill string contacting the bore wall, and these parts may also be suitably protected or adapted. In one particular embodiment of the invention, the contact area of the drill string portion is adapted to provide a cutting or reaming action, as described below.

As will be described, an advantageous effect may be achieved by utilizing an aspect of the present invention to increase the effectiveness and cutting efficiency of a hole-opening device. Certain embodiments of this aspect of the invention may be eccentric or bi-center and utilized where it may be desired to open a bore to a diameter greater than the internal diameter of casing above the unlined bore. In one of these embodiments, the hole-opening device is provided above a pilot section of the drill string and is intended to increase the diameter of a pilot hole. The hole-opening device includes a reaming section or wing which sweeps the well-bore. Conventionally, it is intended and assumed that the pilot section and the reaming section will rotate about a common axis, coincident with the axis of the bore being drilled. However, it is difficult to stabilize such devices and hole-opening operations often suffer from unwanted and detrimental vibrations, significantly reducing drilling efficiency and casting uncertainty on the form of the drilled hole. The cutting action of the reaming wing is resisted by the formation and the findings of the present inventors suggest that the resulting reactive force will tend to push the device across the well bore, inducing chaotic or backward whirl, and reducing the lateral cutting force exerted by the device. If, however, the center of mass of the device, or the center of mass of the bottom hole assembly (BHA) associated with the device, is offset in the bore in the direction of the reaming wing, the centripetal force created by rotating the device will tend to maintain the reaming wing in contact with the formation, and resist reactive forces which would otherwise tend to push the device off the formation or into backwards whirl.

The offsetting of the center of mass may be achieved in a number of ways. In one embodiment, the reaming section of the device, and the drill string above the reaming section, is offset in the bore relative to a stabilizing section below the cutting or reaming section. The stabilizing section acts to centralize the device in the pilot hole.

Alternatively, the offset of the center of mass may be utilized to induce forward whirl, such that the cutting or reaming face of the device is swept around the bore wall. In other embodiments of this invention, the hole-opening device may be of relatively large diameter, and be a relatively tight or snug fit in the bore. The device may be configured to induce or create an offset in the center of mass of the string, such that the centripetal force created by the rotating string pushes a cutting face, arm or blade towards the bore wall. The reaction forces generated by the contact between the cutting surface and bore wall, which tend to push the device away from the bore wall, are resisted by the significant centripetal forces created by the rotating string, which may be bowed towards the cutting face if the clearance between the device and the bore wall permits.

According to a further aspect of the present invention there is provided apparatus for suppressing whirl in a non-vertical bore, the apparatus comprising: a non-rotating body for mounting on a drill string to be located in a non-vertical bore, the body configured to locate an axis of the drill string below an axis of the bore.

According to a still further aspect of the present invention there is provided a method of suppressing whirl in a non-vertical bore, the method comprising: mounting a non-rotating body on a drill string located in a non-vertical bore, whereby an axis of the drill string is located below an axis of the bore.

With a conventional drill string configuration, a section of drill string located in an inclined bore section will tend to lie towards the low side of the bore, with larger diameter sections of the string, such as the drill pipe connections, in contact with the bore wall. As the string rotates, the relative movement between the drill pipe connections and the bore wall tends to cause the string to track around the bore wall in the direction opposite to the direction of string rotation. Thus, a clockwise rotating drill string will tend to track counter-clockwise around the bore wall. This may develop into backward whirl, or at least potentially damaging and inefficient movement of the string relative to the bore axis. However, in these aspects of the present invention, the non-rotating body separates the relatively moving string and bore wall. Also, by offsetting axis of the string towards the low side of the bore, any tendency towards backward whirl requires the string to be raised from the low side of the bore. Given the presence of the non-rotating body, this is most unlikely.

The non-rotating body may be adapted to resist movement in a direction opposite to the direction of string rotation. Thus, the body may include teeth or ridges, which may be configured to operate uni-directionally. Alternatively, or in addition, the body may include a radially extending portion, whereby rotation of the body relative to the bore wall in said opposite direction would tend to lift the body, and the string, from the low side of the bore. Accordingly, such rotation, necessary to induce backward whirl, is suppressed.

These and other aspects of the invention are described in the claims appended hereto. It should be noted that the majority of the various optional and alternative features identified above and in the appended dependent claims may be provided in combination with all or most of the various aspects of the invention.

BRIEF DESCRIPTION OF THE DRAWINGS

These and other aspects of the present invention will now be described, by way of example, with reference to the accompanying drawings, in which.

DETAILED DESCRIPTION OF THE INVENTION

Figure 1:
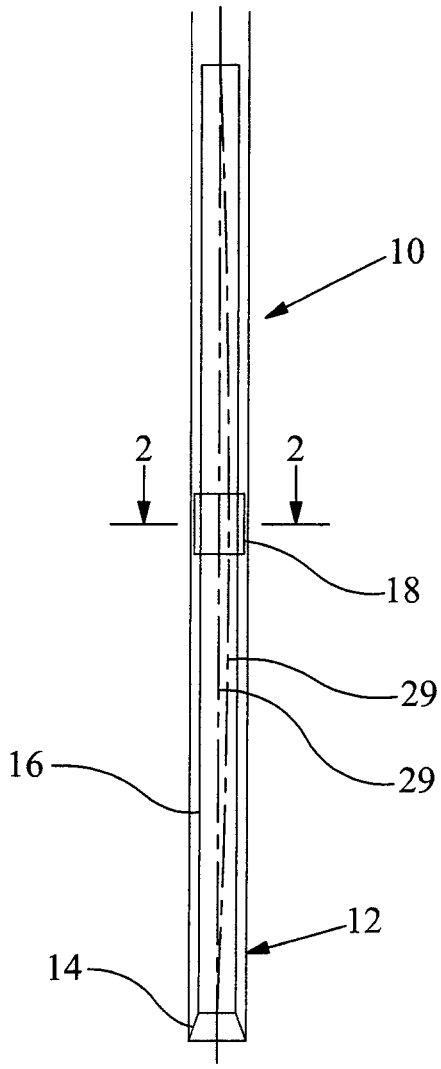
FIG. 1 is a schematic representation of a distal portion of a drill string in accordance with an embodiment of the present invention.

FIG. 1 illustrates the distal or leading end of a drill string 10, configured in accordance with an embodiment of the present invention. The string 10 features a bottom hole assembly (BHA) 12 including a drill bit 14 and drill collars 16. A stabilizer in the form of a device 18 for inducing and maintaining forward whirl is incorporated in the string above the BHA 12.

Figure 2A:
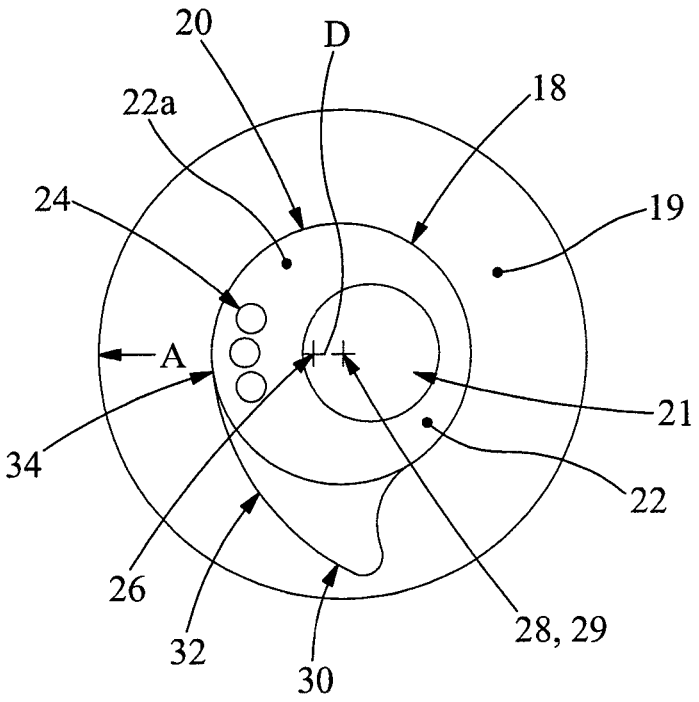
FIGS. 2*a* and 2*b* are enlarged sectional view on line 2-2 of FIG. 1.

Reference is also made to FIG. 2*a* of the drawings, which illustrates the device 18 in cross section, centrally located in the bore 19. The device 18 features a circular mandrel 20 defining a through bore 21 and a surrounding wall 22. The bore 21 is offset to one side of the mandrel 20 and thus one side of the wall 22*a* is thicker than the other, the thicker side also including high density inserts 24. Thus, the center of mass 26 of the device 18 is offset, by distance D, and in the direction of arrow A, from the axis 28 of the bore 19, which in FIG. 2*a* coincides with the mandrel and drill string axis 29.

The device also features a radially extending lobe 30 which is offset from the center of mass offset A.

The surface 32 of the lobe 30 and the adjacent surface 34 of the mandrel are provided with wear-resistant hard facing.

In use, when the string 10 is rotated, the offset center of mass 26 of the device 18 creates an unbalanced centripetal force in the direction of arrow A. Above a certain rotational speed, the force is sufficient to induce deformation, in the form of bowing, in the drill string 10, as indicated in chain-dotted line in FIG. 1. This bowing also tends to induce a corresponding offset in the adjacent portions of the drill string and the BHA, adding significantly to the centripetal effect.

Figure 2B:
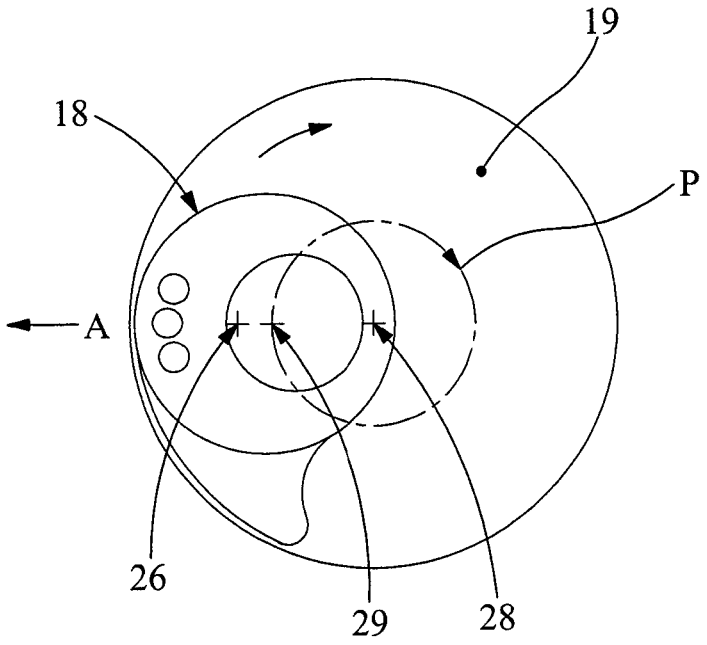

FIG. 2*b* of the drawings illustrates the location of the rotating device 18 in the bore 19, when the string 10 has bowed. The device 18 is rotating with the string 10 in a clockwise direction, but under the influence of the centripetal force has been pushed radially outwards into sliding contact with the bore wall. The device 18 thus now sweeps around the bore 19, the mandrel axis 29 following a substantially circular path or orbit P around the bore axis. This condition is known as forward whirl. The friction between the contacting surfaces of the device 18 and the bore wall produce a reaction force, tending to push the device 18 and the string 10 radially inwards, and also tending to roll the device 18 and the string 10 backwards. However, the significant centripetal force generated by the offsetting of the string in the bore resists this and the presence of the lobe 30 resists backwards rolling. In particular, in order to roll backwards, the device 18 would have to be lifted from the bore wall as the line of contact between the device 18 and the bore wall moved along the lobe 30. Again, this is resisted by the very significant centripetal force generated by the rotating offset string 10.

It will be noted that the device 18 is illustrated as being relatively small in relation to the diameter of the bore 19. In practice, the device 18 will tend to be larger relative to the bore diameter, but in some instances it may be advantageous to have a device of relatively small dimensions, allowing the device 18 to pass through restrictions such as casing and the like, for use in under-reamed bores.

Figure 3:
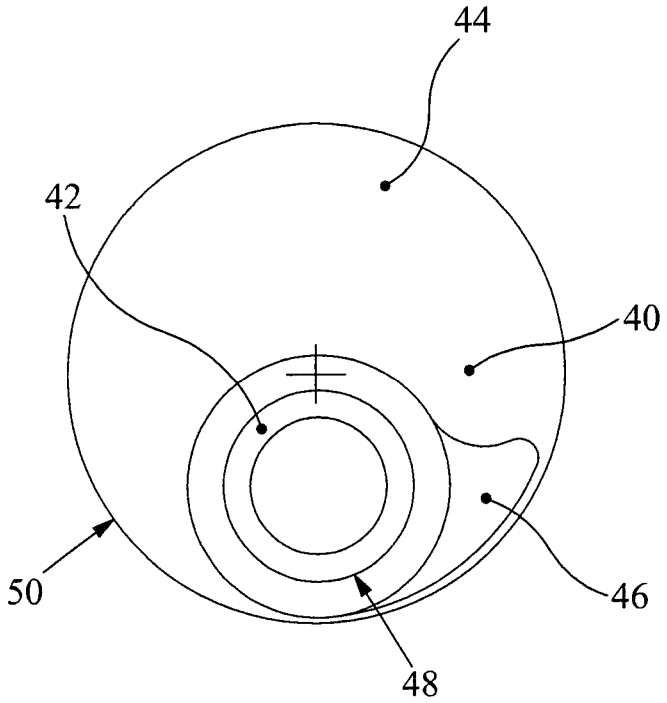
FIGS. 3 and 4 are sectional views of portions of devices in accordance with further embodiments of the present invention.

Reference is now made to FIG. 3 of the drawings, which illustrates a device 40 in accordance with a further embodiment of the present invention, the device 40 for use in resisting rearward and chaotic whirl in a drill string 42 located in an inclined or horizontal bore. In the Figure, the string 42 is lying on the lower side of an inclined bore 44.

The device 40 includes a lobe 46 mounted on the string 42 via a bearing 48. In the absence of the device 40, the contact between the larger diameter elements of the rotating string 42 (rotating clockwise) and the bore wall 50 tends to cause the string 42 to track around the bore wall in a counter-clockwise direction. This may develop into backward whirl, or at least potentially damaging and inefficient chaotic movement of the string relative to the bore axis. However, with the device 40 in place, the presence of the bearing 48 separates the relatively moving string 42 and bore wall 50.

Furthermore, even if bearing friction or drag is sufficient to create a force tending to track the string 42 counter-clockwise round the bore wall 50, this force will act to pivot the string 42 around the lobe 46 and lift the string 42 from the low side of the bore. Of course, the mass of the string 42 will be such that the bearing friction will be insignificant relative to the force of gravity maintaining the string 42 on the low side of the bore, and the lobe 46 will simply rotate on the string 42 and maintain the string 42 on the low side of the bore. Thus, the occurrence of backward or chaotic whirl is suppressed.

Figure 4:
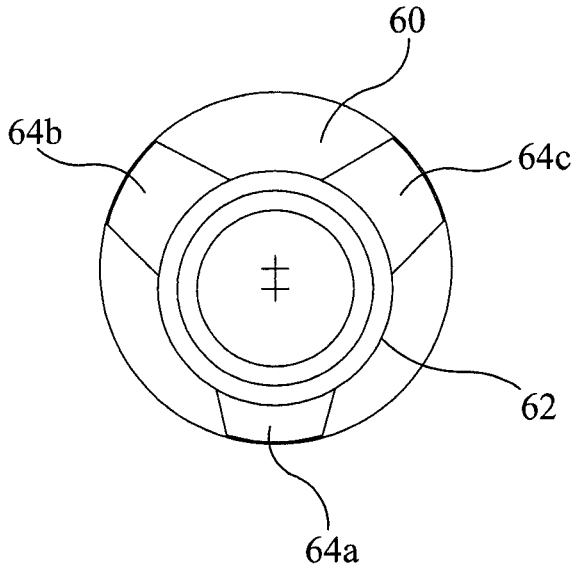

FIG. 4 of the drawings illustrates a device 60 which operates in a similar manner to the device 40 described above, but features a bearing-mounted stabilizer 62 with three blades, one of the blades 64*a* being shorter than the other two blades

64*b*, 64*c*. As with the device 40 described above, any tendency for the string 62 to track counter-clockwise round the bore wall is negated by the presence of the bearing.

It should be noted that a device similar to the device 60 illustrated in FIG. 4 could be provided without a bearing, that is the stabilizer would be rotationally fixed relative to the drill string and rotate with the string. Such a device would tend to induce forward whirl, in a similar manner to the device 18 described above with reference to FIGS. 1, 2*a* and 2*b*.

Figure 5:
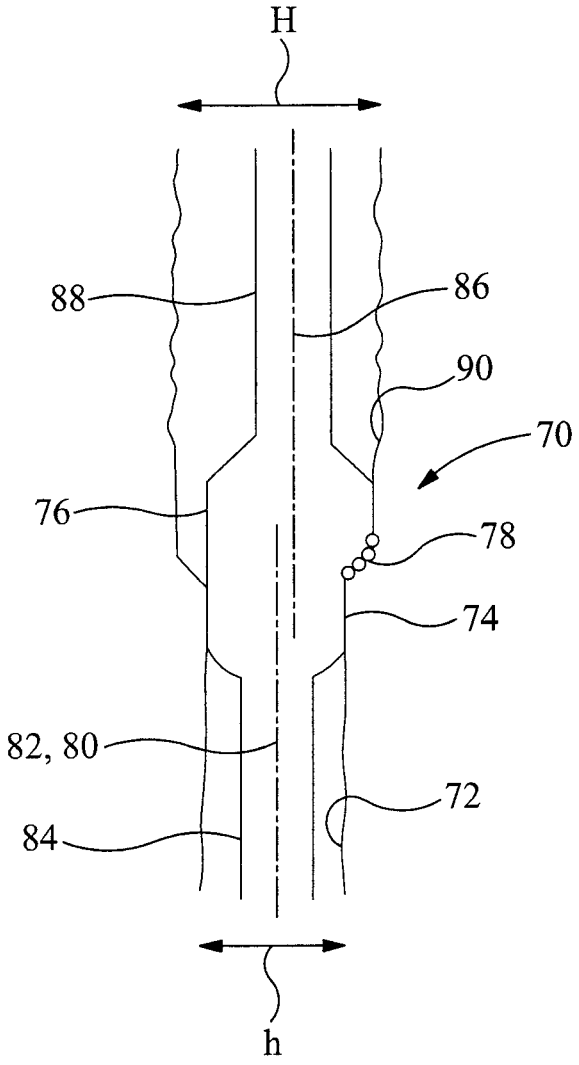
FIG. 5 is a schematic view of a reaming tool in accordance with another aspect of the present invention.

FIG. 5 of the drawings illustrates a hole-opening device 70 in accordance with a further embodiment of the present invention, the device 70 being adapted to be mounted on a drill string above a smaller diameter drill bit (not shown) which has been used to a create pilot hole 72 of diameter h. The device 70 is utilized to open the pilot hole 72 to a larger diameter H.

The device 70 includes a cylindrical stabilizing section 74 of slightly smaller diameter than the pilot hole diameter h. Thus, the device 70 is stabilized by the pilot hole 72. The device 70 includes a cutting section 76, including a cutting face 78, directly above the stabilizing section 74. The axis 80 of the stabilizing section 74 is intended to coincide with the axis 82 of the hole, and coincides with the axis of the drill string section 84 coupling the drill bit and the device 70. However, the axis 86 of the cutting section 76 is offset from the hole axis 82 in the direction of the cutting face 78. Thus, the drill string section 88 directly above the device 70 is also offset.

When the string is rotated, the offset of the cutting section 76 and the offset of the string section 88 are such to offset the center of mass of the device 70 and the string section 88 to create a centripetal force which tends to maintain the cutting face 78 in contact with the bore wall 90, thus enlarging the bore.

The device 70 may include high-density inserts to further offset the center of mass of the device 70 from the bore axis 82 towards the cutting face 78.

The reaction force between the cutting face 78 and the bore wall 90 tends to push the cutting face 78 radially inwards; however the centripetal force is of far greater magnitude and, in combination with the stabilizing effect provided by the stabilizing section 74, maintains the cutting face 78 in contact with the bore wall 90. In other embodiments, a hole-opening device in accordance with an embodiment of the invention may be provided without a stabilizing section. Such a device may be provided with high-density inserts, an offset collar or stabilizer, or some other arrangement, to offset the center of mass of the device from the bore axis towards a cutting face. When such a device is rotated on a string, the offset center of mass creates a centripetal force which tends to induce bowing of the adjacent string in the direction of the offset, further increasing the centripetal force. This force urges the cutting face into contact with the bore wall.

Accordingly, such a device operates in forward whirl, with the cutting face sweeping around the bore wall.

Figure 6:
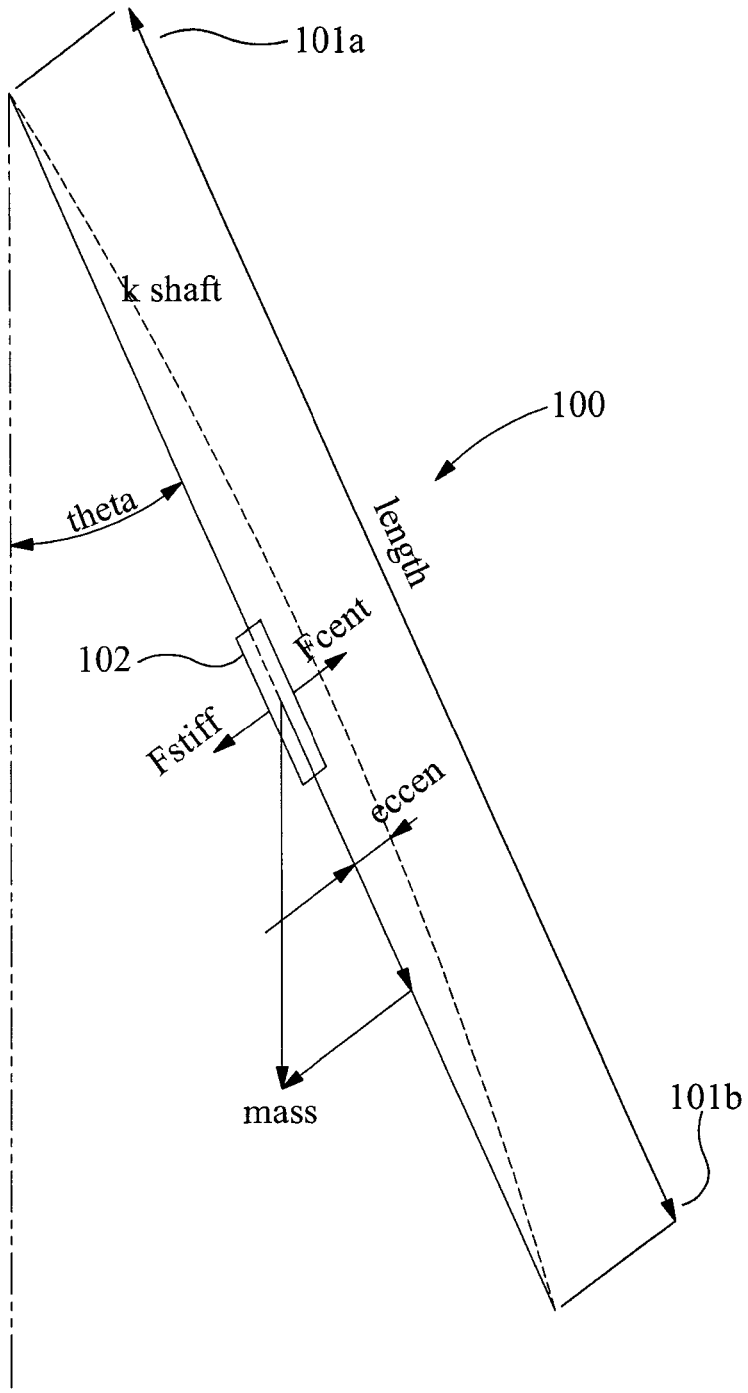
FIG. 6 is a schematic illustration of a portion of a drill string being operated in accordance with an embodiment of the present invention.
Figure 7:
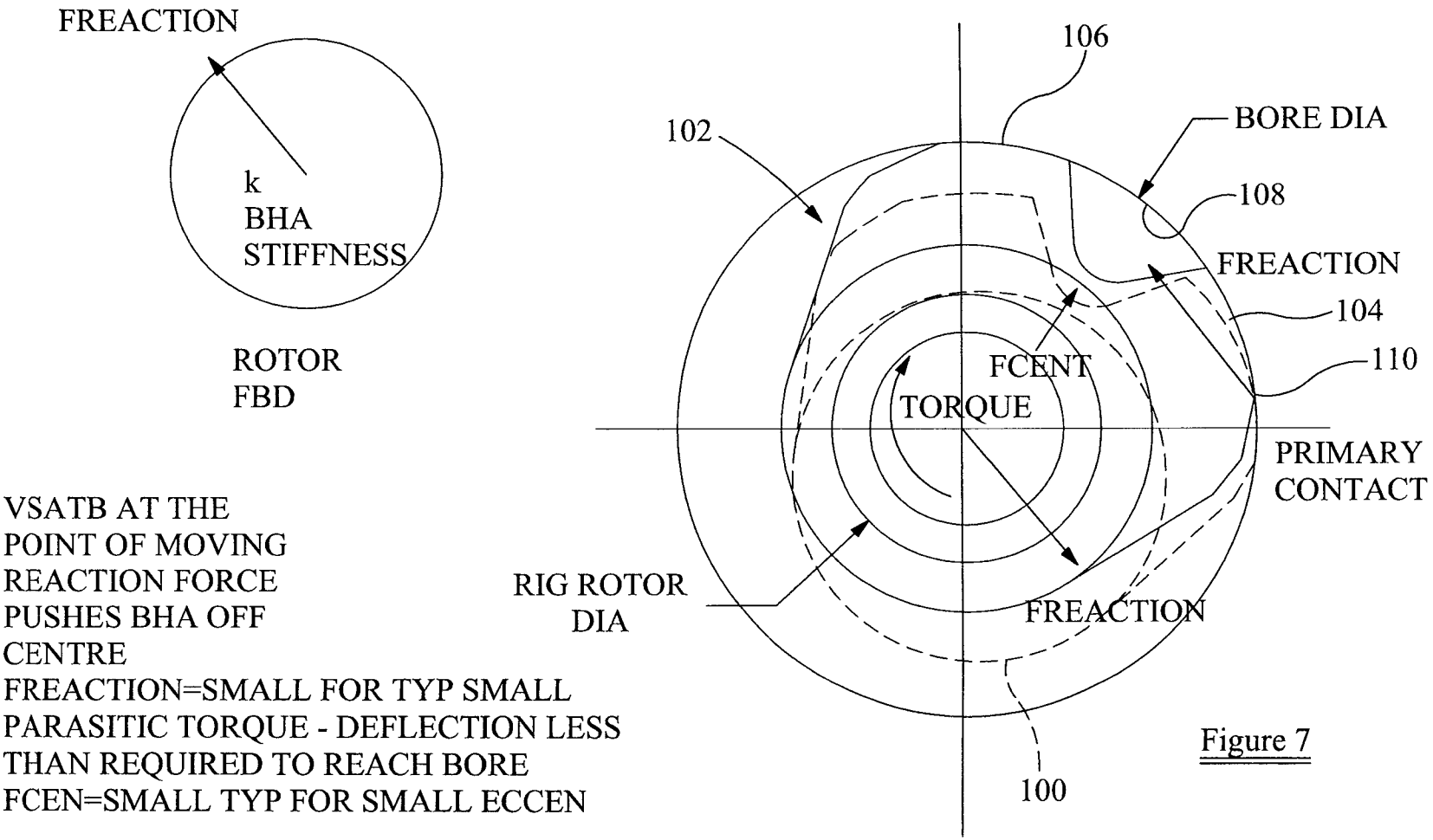
FIGS. 7 and 8 are sectional views of a stabilizer of the string of FIG. 6.
Figure 8:
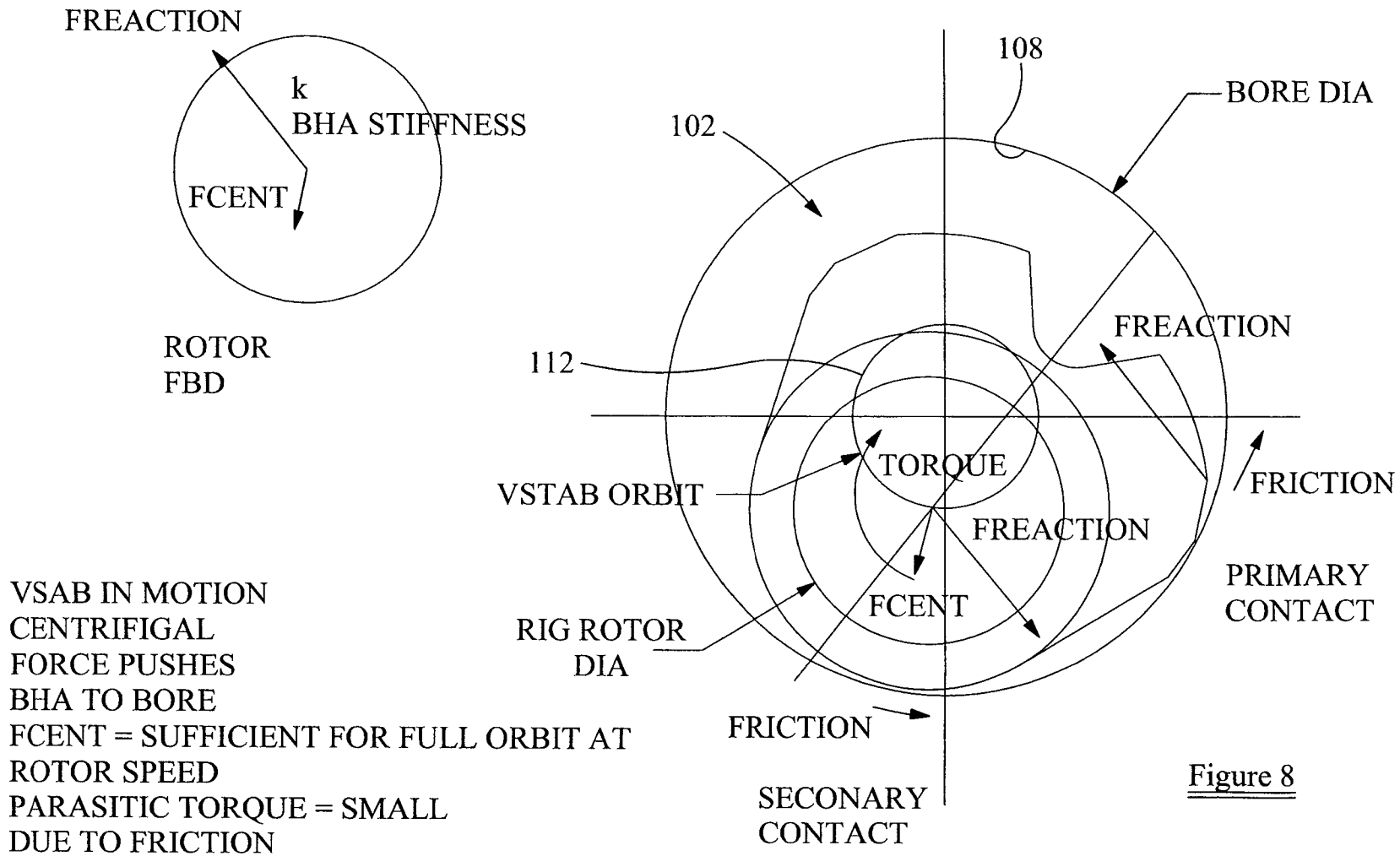

Reference is now made to FIG. 6 of the drawings, which is a schematic illustration of a portion of a drill string being operated in accordance with an embodiment of the present invention; and also to FIGS. 7 and 8, which are sectional views of a stabilizer of the string of FIG. 6.

The drill string section 100 forms part of a drill string, towards the distal end of the string. The section 100 will typically be formed of heavyweight drill pipe and be located directly above the bottom hole assembly (BHA), but may alternatively incorporate part of the BHA. The upper and lower ends of the section 100 are defined by stabilization or touch points 101*a*, 101*b*. The upper point 101*a* may be a conventional stabilizer or drill collar touch point and the lower point 101*b* may also be a stabilizer, such as a near-bit stabilizer, or a collar touch point. Alternatively, the lower point 101*b* may be a reamer, for example a hole-opener. A further stabilizer 102, configured to assist in inducing and maintaining forward whirl, is provided at the mid point of the section 100 and this stabilizer 102 is shown in cross-section in FIGS. 7 and 8. It will be observed that the stabilizer 102 differs from a conventional stabilizer, which is typically configured to centralize the drill string in the bore during a drilling operation. In contrast, the stabilizer 102 of this embodiment is configured to accommodate an offset of the string axis from the bore axis. Indeed, as will be described, the stabilizer 102 is configured to assist in inducing and maintaining such an offset.

As described below, the operating parameters which will initiate and maintain forward whirl in the drill string section 100 may be predetermined and then utilized by the operator to improve the efficiency of the drilling operation. In particular, the rotational speed range of the drill string which will induce and maintain forward whirl is determined.

With knowledge of the drill string section dimensions, mass and material properties (density, Young's modulus), the spring constant (k) for the section 100 may be determined and the first natural frequency then determined. For simplicity, the calculation of the first natural frequency may assume the drill string section 100 comprises a lumped mass, rather than a distributed mass, and it has been found that this provides a reasonable estimation. Thus, the first natural frequency, in terms of rotational speed, is found by taking the square root of the spring constant divided by half the section mass. Of course those of skill in the art will recognize that first natural or critical frequency may be determined or estimated in a number of different ways. At speeds below 70% of the natural frequency it is difficult to achieve and maintain the desired deflection of the drill string section 100. At speeds above 150% of the natural frequency, there is an increasing likelihood of the occurrence of higher order modes of vibration, which tend to disrupt the desired deformation of the section 100. Also, for drilling operations in an inclined bore, the effects of gravity must also be taken into account, and it is possible to determine the minimum speed necessary to maintain the centrifugal force at a level sufficient to maintain the desired bowed form of the section. Below the minimum speed the section 100 may experience a degree of whirl, but if the centrifugal force is insufficient gravity will pull the section 100 away from the upper face of the bore, and the section 100 will not achieve a full orbit around the bore axis. Determination of the appropriate operating parameters may be achieved by, for example, inputting the relevant drill string parameters into a computer or other device running an appropriate software package, resulting in an output of a drill string speed range. Alternatively, an operator may input drill string operating parameters, for example including speed range and bore inclination, and obtain an output of drill string section parameters, such as section length, facilitating design of an appropriate drill string section. The various parameters may be specifically input by an operator, or may be retrieved or input from appropriate databases or other stored information. The output information may be in the form of a simple visual display, or may be fed to other drill string operating or design systems.

During whirl, the stabilizer 102 will be in contact with the bore wall and thus creates a degree of parasitic friction. However, it has been determined that the parasitic friction is at a relatively low level, and the beneficial effects achieved by maintaining the string section in forward whirl more than compensate the related parasitic friction. Furthermore, although the parasitic friction is relatively low, it appears that the friction resulting from the sliding contact between the stabilizer 102 and the bore wall has the effect of damping cyclic effects, such as stick-slip, and facilitates maintaining rotation of the string at a relatively constant speed.

In addition to the use of the natural frequency vibration of the drill string section 100 to achieve whirl, the form of the stabilizer 102 also assists in inducing and maintaining forward whirl. In this embodiment, the stabilizer 102 is eccentric and features two lobes 104, 106 on one side of the stabilizer. As described below, the lobes initially assist in pushing the drill string section off center and in the rotating string the first lobe 104 assists in maintaining the drill string section in forward whirl.

FIG. 7 illustrates the stabilizer 102 at the point of moving, with the drill string section 100 centrally located in the bore 108 and the lobes 104, 106 in contact with the bore wall. Torque is applied to the string to induce clockwise rotation. The primary contact 110 between the bore wall 108 and the leading edge of the first lobe 104 creates a couple tending to push the section 100 off center, to the position shown in chain-dotted outline.

FIG. 8 illustrates the stabilizer 102 once the string is rotating. The rotational speed has been calculated to coincide with the first natural frequency such that the string section 100 assumes a bowed form (as illustrated in chain-dotted outline in FIG. 6), the movement of the middle part of the section off the bore axis, eccentric from the string axis at the stabilization points 101*a*, 101*b*, creating a centrifugal force on the section 100 as the string is rotated. This pushes the string section 100 towards the bore wall until the stabilizer 102 makes contact with the wall. The stabilizer 102 then slides around the bore wall in the orientation as illustrated in FIG. 8, with the stabilizer 102 axis, and thus the axis of the middle portion of the drill string section 100, offset from the bore axis and following a substantially circular orbit 112. The centrifugal force maintains the full orbit as the stabilizer moves around the inclined bore.

Friction creates a drag on the stabilizer 102, such that the stabilizer 102 will tend to track counter-clockwise along the bore wall; if this tracking was left unchecked the stabilizer 102 could go into backwards whirl. However, the tendency to track around the bore is restrained by the presence of the lobe 104. In particular, backwards tracking of the stabilizer past the lobe 104 would require the drill section 100 to be pivoted around the lobe 104, moving the drill string section 100 away from the bore wall, counter to the significant centrifugal force created by the rotating offset. At the operating speeds identified by the previous calculations such movement will not occur, such that the illustrated stabilizer orientation is maintained, and the drill string section 100 remains in forward whirl.

The parts of the stabilizer 102 which will be in sliding contact with the bore wall may be provided with a low friction and wear resistant finish.

As described above, while the drill string section remains in forward whirl, other forms of vibration are avoided, and testing has identified that stick-slip of the distal end of the string is also inhibited, greatly enhancing the efficiency of the drilling operation.

Furthermore, the sweeping motion of the string and stabilizer will also assist in bore cleaning, agitating cuttings or other material that might otherwise collect on the low side of an inclined bore.

Whereas the present invention has been described in particular relation to the drawings attached hereto, it will be apparent to those of skill in the art that the above-described embodiments are merely exemplary of the present invention, and that various modifications and improvements may be made thereto within the scope and spirit of the present invention, without departing from the scope of the invention.

What is claimed is:

1. A drilling method comprising controlling operation of a drill string to maintain at least a portion of the drill string in forward whirl wherein controlling operation of the drill string comprises initiating forward whirl in said portion of the drill string, selecting an appropriate drill string configuration to maintain forward whirl, the portion of the drill string having at least one radial projection positionable in contact with a wall of the wellbore, and selecting appropriate operating parameters to maintain forward whirl.

2. The drilling method of claim 1 further comprising selecting at least one of drill string configuration and drill string operating parameters to offset an intermediate portion of a rotating drill string from a bore axis and maintain said intermediate portion in an orbit in the direction of rotation.

3. The drilling method of claim 2, comprising offsetting a center of mass of said portion relative to adjacent portions of the drill string.

4. The drilling method of claim 2, comprising offsetting a center of mass of said portion relative to the bore axis.

5. The drilling method of claim 2, comprising incorporating an eccentric mass in the drill string portion.

6. The drilling method of claim 2, comprising rotating the drill string at a predetermined speed associated with a first order vibration of said portion of the drill string.

7. The drilling method of claim 2, comprising rotating the drill string at a predetermined speed within the range of 70% and 150% of a speed associated with a first natural frequency of said portion of the drill string.

8. The drilling method of claim 2, wherein said drill string portion includes at least a portion of a bottom hole assembly.

9. The drilling method of claim 8, comprising locating said portion of the drill string in a non-vertical bore.

10. The drilling method of claim 1, comprising configuring said portion of the drill string whereby rotation of the drill string creates a centrifugal force tending to urge said drill string portion towards the bore wall.

11. The drilling method of claim 1, comprising maintaining part of said portion of the drill string in sliding contact with a bore wall.

12. The drilling method of claim 11, comprising providing a stabilizer having the radial projection on said portion of the drill string.

13. The drilling method of claim 1, comprising providing a stabilizer configured to accommodate an offset of the drill string from the bore axis on said drill string portion.

14. The drilling method of claim 13, comprising inducing a first order vibration in said portion of the drill string.

15. The drilling method of claim 1, wherein said portion of the drill string extends between upper and lower stabilization or touch points.

16. The drilling method of claim 1, comprising configuring the drill string such that a predetermined drilling speed of the drill string will overlap with a range of 70% to 150% of a speed associated with a first order natural frequency of the drill string portion.

17. The drilling method of claim 16, wherein said drill string portion is located towards the distal end of the string.

18. A drilling apparatus configured to maintain a drill string in forward whirl when the drill string is operated within predetermined parameters comprising:

a drill bit configured to be centered in a drilled bore;

a portion of the drill string configured to offset an axis of the portion from a bore axis, a center of mass of said portion being offset relative to portions of the drill string whereby rotation of the drill string incorporating said portion tends to maintain said portion in an orbit in the direction of rotation while the drill bit remains centered in the bore, the portion of the drill string having at least one radial projection positionable in contact with a wall of the wellbore, the at least one radial projection defining an outer diameter offset from a diameter of the portion.

19. The drilling apparatus of claim 18, wherein the drill string portion is configured to initiate forward whirl in said portion of the drill string.

20. The drilling apparatus of claim 19 wherein said portion of the drill string is configured to maintain part of said portion in sliding contact with a bore wall.

21. The drilling apparatus of claim 18, wherein a center of mass of said portion is offset relative to adjacent portions of the drill string.

22. The drilling apparatus of claim 21, wherein said portion of the string is configured to minimize friction between a contact surface of the portion and the bore wall.

23. The drilling apparatus of claim 22, comprising a bearing sleeve rotatably mounted on said portion of the string.

24. The drilling apparatus of claim 18, wherein the drill string portion is configured such that, in use, a center of mass of said portion is offset relative to the bore axis.

25. The drilling apparatus of claim 18, comprising an eccentric mass in the drill string portion.

26. The drilling apparatus of claim 18, wherein said portion of the drill string is configured such that rotation of the drill string creates a centrifugal force tending to urge said drill string portion towards the bore wall.

27. The drilling apparatus of claim 18, comprising a stabilizer having the radial projection on said portion of the drill string.

28. The drilling apparatus of claim 27, wherein the stabilizer is an eccentric stabilizer configured to accommodate an offset of an axis of the drill string portion from the bore axis.

29. The drilling apparatus of claim 28, wherein said portion of the drill string extends between upper and lower stabilization or touch points.

30. The drilling apparatus of claim 28, wherein the said portion of the drill string is configured for location towards the distal end of the string.

31. The drilling apparatus of claim 30, wherein said portion of the drill string includes at least a portion of a bottom hole assembly.

32. The drilling apparatus of claim 18, wherein the drill string portion comprises a bent sub to offset a center of mass of said portion relative to adjacent portions of the string.

33. The drilling apparatus of claim 32, wherein said drill string portion is configured to deform to move the portion radially in the bore, and thus move a center of mass of the portion away from the bore axis and the axis of rotation of adjacent portions of the string.

34. The drilling apparatus of claim 33, wherein the drill string portion is configured to provide an offset such that a deflection of the drill string portion to induce forward whirl only occurs above a predetermined rotational speed.

35. The drilling apparatus of claim 34, wherein said predetermined rotational speed is selected to be within normal operating parameters of the drill string.

36. The drilling apparatus of claim 34, wherein said predetermined rotational speed is selected to be above normal operating parameters of the drill string.

37. The drilling apparatus of claim 18, wherein the drill string portion includes a surface area configured to accommodate prolonged contact with the bore wall.

38. The drilling apparatus of claim 37, wherein said surface area includes at least one of a wear-resistant facing and a wear-resistant insert.

39. The drilling apparatus of claim 38, wherein said surface area is configured to provide a cutting function.

40. The drilling apparatus of claim 39, wherein said surface area forms part of a hole-opening device.

41. The drilling apparatus of claim 40, wherein the hole-opening device is one of eccentric and bi-center and is configured to open a lower bore section to a diameter greater than the internal diameter of an upper bore section.

42. The drilling apparatus of claim 41, wherein the hole-opening device is provided above a pilot section of the drill string and is configured to increase the diameter of a pilot hole.

43. The drilling apparatus of claim 41, wherein the hole-opening device includes a reaming section configured to sweep the bore wall.

44. The drilling apparatus of claim 43, wherein a center of mass associated with the hole-opening device is offset in the direction of the reaming section, whereby centripetal force created by rotating the device tends to maintain the reaming section in contact with the bore wall.

45. The drilling apparatus of claim 44, wherein the reaming section is offset relative to a stabilizing section below the reaming section, the stabilizing section configured to centralize the hole-opening device in the pilot hole.

46. A method of controlling vibration in a drill string during a drilling operation, the method comprising at least one of:

purposively inducing forward whirl in a distal portion of the drill string, and resisting backward or chaotic whirl, and further comprising suppressing the backward or chaotic whirl in a non-vertical bore, mounting a non-rotating body on the drill string, the non-rotating body comprising stabilizer blades extending radially therefrom; and locating the drill string in the non-vertical bore such that an axis of the drill string is located below an axis of the bore.

47. An apparatus for suppressing whirl in a non-vertical bore, the apparatus comprising:

a non-rotating body for mounting on a bearing on a drill string to be located in a non-vertical bore, the non-rotating body configured to locate an axis of the drill string below an axis of the bore;

wherein the non-rotating body is configured to resist movement in a direction opposite to the direction of string rotation, the non-rotating body comprising stabilizer blades extending radially therefrom, the stabilizer blades defining an outer diameter offset from a diameter of the drill string, at least one of the stabilizer blades being shorter than at least one other of the stabilizer blades.

48. The drilling apparatus of claim 47, wherein the non-rotating body includes a radially offset projection.

49. A drilling apparatus configured to maintain the drill string in forward whirl when the drill string is operated within predetermined parameters comprising:

a portion of the drill string comprising a hole-opening device including a reaming section configured to sweep the bore wall, the portion of the drill string configured to offset an axis of the portion from a reamed bore axis, whereby rotation of the drill string incorporating the portion tends to maintain the portion in an orbit in the direction of rotation;

wherein a center of mass associated with the hole-opening device is offset from another portion of the drill string and in the direction of the reaming section, whereby centripetal force created by rotating the device tends to maintain the reaming section in contact with the bore wall.

50. The drilling apparatus of claim 49, wherein the reaming section is offset relative to a stabilizing section below the reaming section, the stabilizing section configured to centralize the hole-opening device in the pilot hole.

51. The drilling apparatus of claim 49, wherein the drill string portion includes a surface area configured to contact with the bore wall and wherein said surface area is configured to provide a cutting function.

52. The drilling apparatus of claim 51, wherein said surface area forms part of the hole-opening device.

53. The drilling apparatus of claim 52, wherein the hole-opening device is one of eccentric and bi-center and is configured to open a lower bore section to a diameter greater than an internal diameter of an upper bore section.

54. The drilling apparatus of claim 53, wherein the hole-opening device is provided above a pilot section of the drill string and is configured to increase the diameter of a pilot hole.

* * * * *